US010655287B2

(12) United States Patent
Cousin et al.

(10) Patent No.: US 10,655,287 B2
(45) Date of Patent: May 19, 2020

(54) REINFORCEMENT APPARATUS FOR REINFORCING A STRUCTURE COMPRISING A PIER AND A CROSS-BEAM

(71) Applicant: SOLETANCHE FREYSSINET, Rueil Malmaison (FR)

(72) Inventors: Boris Cousin, London (GB); Paul Arthur Bottomley, Telford (GB)

(73) Assignee: SOLETENCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 16/096,240

(22) PCT Filed: May 10, 2016

(86) PCT No.: PCT/IB2016/000767

§ 371 (c)(1),
(2) Date: Oct. 24, 2018

(87) PCT Pub. No.: WO2017/194986

PCT Pub. Date: Nov. 16, 2017

(65) Prior Publication Data

US 2019/0161925 A1 May 30, 2019

(51) Int. Cl.

| | |
|---|---|
| ***E01D 22/00*** | (2006.01) |
| ***E01D 19/04*** | (2006.01) |
| *E01D 19/02* | (2006.01) |

(52) U.S. Cl.
CPC ..... *E01D 22/00* (2013.01); *E01D 19/04* (2013.01); *E01D 19/02* (2013.01)

(58) Field of Classification Search
CPC ..... E01D 19/02; E01D 19/04; E01D 22/00
USPC ..... 14/75, 77.3
See application file for complete search history.

(56) References Cited

U.S. PATENT DOCUMENTS

| | | | | | |
|---|---|---|---|---|---|
| 106,647 | A | * | 8/1870 | Allen | E02D 19/42 14/75 |
| 887,008 | A | * | 5/1908 | Morton | E02D 19/02 14/75 |
| 1,340,397 | A | * | 5/1920 | Nagel | E02D 5/10 14/75 |
| 2,317,016 | A | * | 4/1943 | Allen | E02D 27/20 14/75 |

(Continued)

FOREIGN PATENT DOCUMENTS

| | | |
|---|---|---|
| GB | 2 420 365 A | 5/2006 |
| JP | 2007-321486 A | 12/2007 |

(Continued)

*Primary Examiner* — Raymond W Addie
(74) *Attorney, Agent, or Firm* — Dentons US LLP

(57) ABSTRACT

A reinforcement apparatus for reinforcing a structure comprising at least one pier bearing on foundations, a cross-beam bearing on said pier and at least one structure element located above the cross-beam, the reinforcement apparatus comprising at least one column (20) destined to surround the pier at least partly, to be mechanically coupled to the pier and to bear on said foundations, and at least one transverse beam (22) fixed relative to the column and destined to be mechanically coupled to the cross-beam, and at least one load transfer element (36) arranged on an upper face of said at least one transverse beam (22) to take up at least part of the load of the structure element.

18 Claims, 9 Drawing Sheets

(56) References Cited

U.S. PATENT DOCUMENTS

| | | | | | |
|---|---|---|---|---|---|
| 2,426,477 | A * | 8/1947 | Walton | E02B 3/068 | 14/75 |
| 5,406,663 | A * | 4/1995 | Chen | E01C 3/006 | 14/75 |
| 6,023,806 | A * | 2/2000 | Dumlao | B63B 5/00 | 14/73 |
| 2004/0074022 | A1* | 4/2004 | Tokuno | E01D 2/00 | 14/73 |
| 2006/0117504 | A1* | 6/2006 | Ronald | E01D 19/125 | 14/73 |
| 2008/0196341 | A1* | 8/2008 | Kang | E01D 19/02 | 52/292 |
| 2010/0037539 | A1* | 2/2010 | Clarke | E02D 27/42 | 52/169.5 |

FOREIGN PATENT DOCUMENTS

| | | | |
|---|---|---|---|
| JP | 2012-144918 | A | 8/2012 |
| JP | 2015-214857 | A | 12/2015 |

* cited by examiner

REINFORCEMENT APPARATUS FOR REINFORCING A STRUCTURE COMPRISING A PIER AND A CROSS-BEAM

This application is a National Stage Application of International Application No. PCT/IB2016/000767, filed on May 10, 2016, which is hereby incorporated by reference in its entirety for all purposes as if fully set forth herein.

The invention pertains to the field of structures comprising piers, and in particular to the reinforcements of such structures.

BACKGROUND

Such structures, which are in particular present in multi-span bridges, comprise piers which bear on foundations in the ground and are used to support bridge elements such as a deck over which vehicles and/or pedestrians may pass.

Over time, such structures tend to degrade, for instance under the influence of natural elements or of malicious acts.

These degradations translate for example into the concrete of different components of the structure deteriorating, thereby reducing the structural properties of the structure.

In other situations, the load capacity of the structure may simply need upgrading, for instance due to a greater traffic capacity being needed on the bridge.

In such configurations, different approaches aimed at solving these problems are commonly employed. One approach lies in adjoining a reinforcement apparatus to the structure which is designed to take up at least part of the strains applied by the bridge elements to the piers.

The most commonly encountered reinforcement apparatus designed to that end presents itself in the form of an additional skin of reinforcing material such as concrete laid out around the initial piers. The skin is setup through a partial or complete demolition of the existing piers, anchoring reinforcement bars in the structure in the desired area, and pouring concrete in a space around the pier within which the bars are located.

This way of proceeding presents drawbacks. In particular, it requires that the existing structure be temporarily weakened due to its being partly or fully demolished. This weakening requires that the structure be temporarily propped, which increases the cost and duration of the whole operation without entirely removing the risk factor that the partial or full demolition constitutes.

The present invention seeks to improve this situation.

SUMMARY

To this end, the invention relates to a reinforcement apparatus for reinforcing a structure comprising at least one pier bearing on foundations, a cross-beam bearing on said pier and at least one structure element located above the cross-beam, the reinforcement apparatus comprising at least one column destined to surround the pier at least partly, to be mechanically coupled to the pier and to bear on said foundations, and at least one transverse beam fixed relative to the column and destined to be mechanically coupled to the cross-beam.

According to an aspect of the invention, the column comprises a plurality of prefabricated column elements assembled together.

According to an aspect of the invention, the transverse beam comprises a plurality of prefabricated beam elements assembled together.

According to an aspect of the invention, the column comprises two column faces facing the pier and respectively located on opposite sides of the pier.

According to an aspect of the invention, each column face and the pier define a gap therebetween, each gap being at least partly filled with a reinforcing material.

According to an aspect of the invention, the reinforcing material mechanically couples each column face to the pier.

According to an aspect of the invention, the column further comprises a casing surrounding the pier at least partly, said casing being made of the reinforcing material at least in part.

According to an aspect of the invention, the reinforcement apparatus comprises two transverse beams respectively arranged on two opposite sides of the cross-beam.

According to an aspect of the invention, each transverse beam and the cross-beam define a space therebetween, each space being at least partly filled with a reinforcement material which mechanically couples the transverse beams to the cross-beam.

According to an aspect of the invention, the reinforcement material is in the form of a reinforcement casing encapsulating at least part of the cross-beam.

According to an aspect of the invention, the reinforcement apparatus further comprises at least one load transfer element arranged on an upper face of said at least one transverse beam to take up at least part of the load of the structure element.

According to an aspect of the invention, the structure comprises a plurality of piers bearing on the foundations, the cross-beam bearing on said plurality of piers, and the reinforcement apparatus comprises, for each pier the cross-beam is bearing on, a column destined to surround said pier at least partly, to be mechanically coupled to the pier and to bear on said foundations.

The invention further relates to an assembly comprising:

- a structure comprising at least one pier bearing on foundations, a cross-beam bearing on said pier and at least one structure element located above the cross-beam, and
- a reinforcement apparatus as defined above, the column of the reinforcement apparatus surrounding the pier at least partly, being mechanically coupled to the pier and bearing on said foundations, the transverse beam of the reinforcement apparatus being fixed relative to the column and being mechanically coupled to the cross-beam.

The invention also relates to a method of building a reinforcement apparatus for reinforcing a structure comprising at least one pier bearing on foundations, a cross-beam bearing on said pier and at least one structure element located above the cross-beam, the reinforcement apparatus comprising at least one column destined to surround the pier at least partly, to be mechanically coupled to the pier and to bear on said foundations, and at least one transverse beam fixed relative to the column and destined to be mechanically coupled to the cross-beam, the method comprising:

- forming the transverse beam,
- lifting the transverse beam towards the cross-beam,
- forming at least part of the column so as to have said at least part of the column bear on the foundations, said forming at least part of the column including arranging said at least part of the column and the transverse beam in a fixed relative position,
- mechanically coupling said at least part of the column to the pier to form the column and mechanically coupling the transverse beam to the cross-beam.

According to an aspect of the invention, forming the transverse beam comprises assembling together a plurality of prefabricated beam elements.

According to an aspect of the invention, forming at least part of the column comprises:

arranging column elements around the pier and securing said columns elements together so as to define a stage of the column, attaching the stage to the transverse beam, lifting the transverse beam and the stage to free up space below said stage, arranging new column elements around the pier in the space which has been freed-up and securing said new columns elements together so as to define a new stage of the column, securing the new stage to the stage of the column previously formed.

According to an aspect of the invention, the column comprises two column faces facing the pier and respectively located on opposite sides of the pier, mechanically coupling said at least part of the column to the pier comprising filling at least part of each gap defined between a column face and the pier with a reinforcing material.

According to an aspect of the invention, the method further comprises coupling formwork elements to the two column faces to define conjointly with the column faces an inner space which comprise the gaps between the column faces and the pier, and filling said inner space at least in part with the reinforcing material to form a casing with encapsulates at least part of the pier.

According to an aspect of the invention, the reinforcement apparatus comprises two transverse beams respectively arranged on two opposite sides of the cross-beam, the method further comprising coupling formwork elements to the two transverse beams to define an inner volume which comprises spaces defined between the transverse beams and the cross-beam, and filling said inner volume at least in part with a reinforcement material to define a reinforcement casing which encapsulates at least part of the cross-beam.

According to an aspect of the invention, the inner space and the inner volume are in fluid communication, and the operations of filling said inner space and inner volume are carried out in a single filling step.

According to an aspect of the invention, the method further comprises arranging at least one load transfer element on an upper face of the transverse beam and having said load transfer element come in contact with the structure element so as to take up at least part of a load the structure element previously applied to the cross-head.

According to an aspect of the invention, the method further comprises securing a platform destined to be suspended to the transverse beam while the transverse beam is being formed or after the transverse beam has been formed.

BRIEF DESCRIPTION OF THE DRAWINGS

Further features and advantages of the invention will become more apparent by reading the following detailed description of the embodiments, which are given by way of non-limiting examples with reference to the appended drawings, in which.

DESCRIPTION OF EMBODIMENTS

Figure 1:
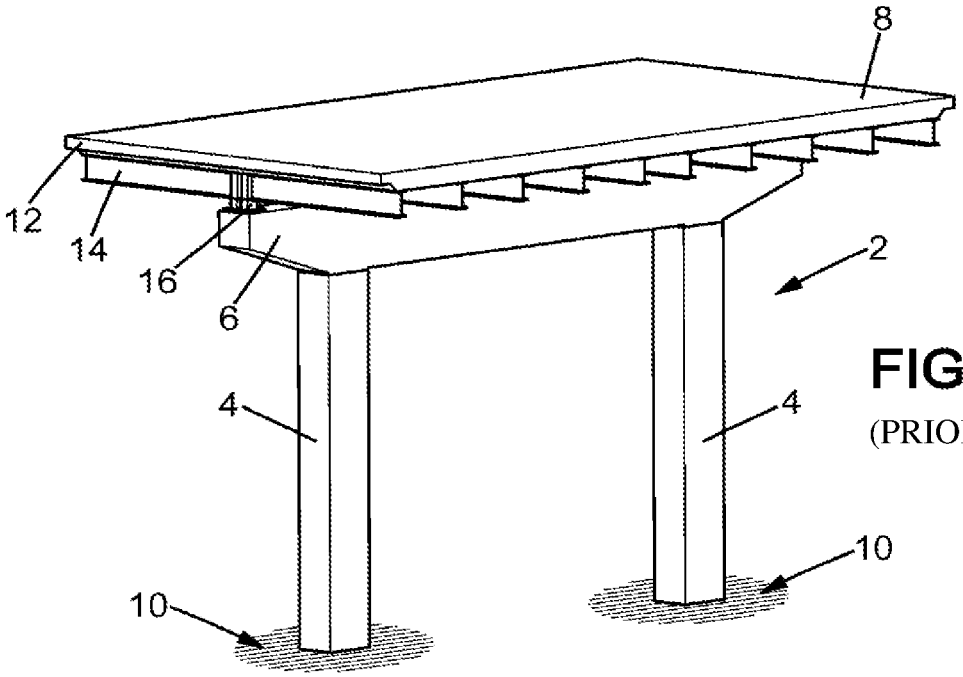
FIG. 1 (PRIOR ART)
FIG. 1 illustrates a structure destined to be coupled to a reinforcement apparatus according to the invention.

FIG. 1 illustrates a structure 2 to which a reinforcement apparatus according to the invention is destined to be coupled.

The structure 2 forms part or constitutes a civil engineering works, such as a multi-span bridge.

In the following description, the structure 2 is considered to form part of a multi-span bridge for illustrative purposes.

The structure 2 comprises at least one pier 4, a cross-beam 6 and a structure element 8.

The pier 4 is configured to support the rest of the structure 2, in particular the structure element 8, hereinafter element 8.

The pier presents itself in the form of a column extending substantially vertically (although the word column is used to designate another element of the invention).

In some technical fields such as that of bridges, the word pier may be used to designate the group of columns through which a deck segment of a bridge bears on its foundations. In the present application, this term is to be understood as referring to a single of such columns.

The pier 4 bears on foundations 10 of the structure, and stretches upward toward the element 8.

The pier 4 is made of any known material, such as reinforced concrete.

Its cross-section has a shape having any known form. For instance, this cross-section is rectangular. For instance, its height is greater than 5 m, and is in an example greater than 10 m.

Figure 2:
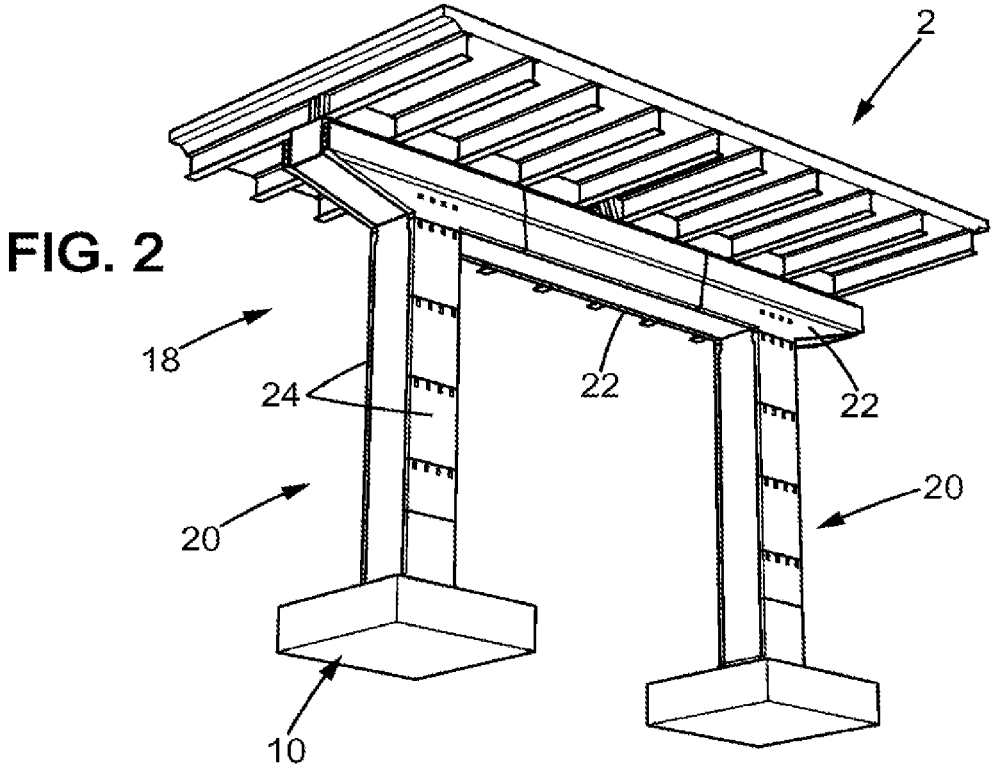
FIG. 2 illustrates the structure of FIG. 1 and a reinforcement apparatus according to the invention coupled thereto.

In the example of FIG. 2, the structure 2 comprises two piers 4 which are spread apart along a longitudinal direction of the element 8. However, the structure may comprise any given number of piers, such as one or more than two.

The cross-beam 6 is configured to transfer the loads applied by the element 8 to the piers.

The cross-beam 6 stretches between the two piers 4 and is arranged on an upper end of the piers.

In addition, the cross-beam 6 supports the element 8.

In the example of FIG. 1, the cross-beam 6 presents itself in the form of a beam which stretches along the longitudinal direction of the element 8. Its comprises a central portion overhanging the gap between the piers and which bears at its ends on the piers, and two side portions which each extend beyond one of the piers from the central portion. For instance, these side portions have a trapezoid shape, although any configuration may be envisaged regarding the side portions, even configurations in which the cross-beam does not exhibit side portions.

The cross-beam may be composed of any known material, such as reinforced concrete.

The element 8 forms all or part of a deck of the structure 2. In other words, it is a deck segment of the structure 2.

The element 8 stretches along a longitudinal direction.

The element 8 comprises an upper portion 12 having an upper face destined to be used as a passageway, for instance for vehicles or pedestrians. It should be noted that the direction along which the vehicles move on the element 8 may be perpendicular to the longitudinal direction of the element 8. In other words, the element 8 may be a transverse deck segment, and the piers and the cross-beam form supporting elements of the transverse deck segment.

The element 8 further comprises beams 14 secured to a bottom face of the upper portion and arranged transversely relative to the longitudinal direction of the element 8. These beams 14 are for instance made of steel.

In addition, it comprises bearings 16 arranged between the cross-beam 6 and the beams 14 for transferring the load of the element 8 to the cross-beam and the piers.

FIG. 2 illustrates a reinforcement apparatus 18 according to the invention which has been coupled to the structure of FIG. 1.

The apparatus and the structure thus form an integrated assembly.

The apparatus 18 is configured to reinforce the structure. More precisely, it is configured to take up at least part of the loads of the structure 2 within the assembly.

The apparatus 18 is a permanent reinforcing structure, as opposed to a temporary one which is set up to temporarily strengthen or repair the structure and which is removed thereafter. In other words, after having been built, the apparatus is kept in place and permanently reinforces the structure 2.

In particular, the apparatus is configured to last through the entire lifespan of the structure. For instance, the apparatus is configured to stay coupled to the structure for a duration greater than several decades, for instance greater than 60 years. Advantageously, it is configured to stay coupled to the structure for over a hundred years.

The reinforcement apparatus 18, hereinafter apparatus 18, comprises at least one column 20 and one transverse beam 22.

In effect, the apparatus 18 advantageously comprises a plurality of columns. More precisely, it comprises a column for each pier on which the cross-beam bears.

Each column 20 bears on the foundations 10. In addition, each column extends upwardly from the foundation towards the bottom face of the element 8. The upper end of each column is located approximately at the same height as that of the pier.

Each column is mechanically coupled to the corresponding pier. In other words, the column and the corresponding pier are in contact with one another so that loads may be transferred therebetween.

Each column has a cross-section having an external shape of any known form.

For instance, this shape is polygonal such as rectangular, or curved, such as circular.

This shape may match the shape of the cross-section of the pier. Alternatively, its external shape is independent from that of the pier. In the example of FIG. 2, both the piers and the column have rectangular cross-sections.

Each column 20 is hollow and defines an inner cavity within which the corresponding pier is received. The pier is then entirely surrounded by the column, or is only partly surrounded. By only partly surrounded, it is understood that the pier is surrounded over only part of its height and/or only part of its circumference.

Advantageously, as in the embodiment of the Figures, each pier is entirely surrounded by the corresponding column 20. Each column then forms an outer shell that circumferentially encapsulates the pier over its entire height. This configuration serves to enhance the load transfers between the two structure components and to protect the pier.

Figure 3:
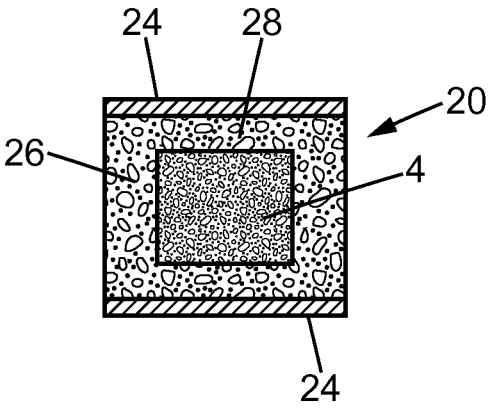
FIG. 3 illustrates a cross-section of a portion of the assembly of FIG. 2.

In reference to FIG. 3 which illustrates a cross-section of a column 20 and of the pier it receives, each column 20 comprises two column faces 24 and a reinforcement casing 26.

The two column faces 24 face the pier and are respectively located on opposite sides of the pier 4. In FIG. 2, the faces 24 of a given column 20 correspond to the front and back faces of the column respectively (in the sense of the orientation of FIG. 2).

The two faces 24 of a given pier face each other and stretch upwardly.

Each face 24 presents itself in the general form of a panel. They present a general form which corresponds to that of the exterior shape of the casing 26.

For instance, they are curved, and each form of a portion of a circle or an ellipse. In some embodiments, the lateral ends of the faces 24 of a given pier are in contact in another. In other words, the two faces 24 are arranged to surround the entire circumference of the casing.

Alternatively, the faces are substantially planar. The following description is given in a non-limiting manner for this configuration.

In this configuration, the two faces 24 of a given pier are arranged in parallel relative to one another.

Each face 24 preferably extends from the foundations on which the column lies to the transverse beam 22, which is located in the vicinity of the cross-beam as discussed below.

Each face 24 is spread apart from the pier, defining a gap 28 therebetween. As described below, this gap is filled by the casing at least in part.

Each face 24 is in contact with the casing 26, and is fixed relative to the casing 26. Each face is mechanically coupled to the pier via the casing, as also described in more details below.

Each face 24 advantageously comprises prefabricated face elements which are assembled together to form at least part of the face. For instance, these prefabricated elements are in the form of vertical panels which each run over a portion of the entire height of the column. The prefabricated elements are attached to one another using any known means.

These prefabricated elements are advantageously made of concrete. Most advantageously, they are made of ultra-high performance fiber reinforced concrete, or UHPFRC. They are advantageously made through a moulding process using a mould (or cast). They then form precast elements.

In some configurations, the prefabricated elements may be made of a material other than concrete, such as metal.

However, the faces 24, regardless of whether they are made of prefabricated components or not, are advantageously made of concrete and most advantageously made of UHPFRC.

Their thickness is for instance comprised between 100 mm and 300 mm.

The casing 26 is configured to mechanically couple the column faces 24 to the pier. Advantageously, it is configured to do so by encapsulating the pier (at least in part).

The casing 26 presents itself in the form of an external skin around the pier, the pier being received therethrough.

Its cross-section has any known form, and is for instance rectangular or has an external circular shape. For a rectangular shape, the casing 26 then presents four planar sides, including two opposite sides against each of which one of the faces 24 is applied. The casing 26 fills at least part of the gap between the faces 24 and the pier 4. The two remaining opposite sides are for instance free of any form of cover and are in contact with the surrounding air. Alternatively, as described in more details herebelow, they may be covered by an absorptive form.

The casing is made of reinforcing material. This material is advantageously concrete.

Figure 4:
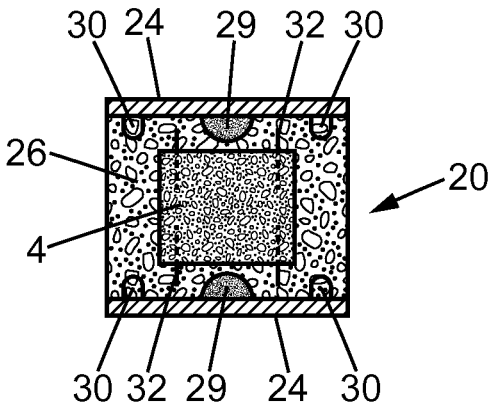
FIG. 4 illustrates another embodiment of the section of FIG. 3.

In reference to FIG. 4, advantageously, the inner surface of the faces 24 are provided with spacing elements 29 configured to maintain the corresponding face 24 apart from the pier. These elements 29 ensure that the faces 24 are apart from the pier while the casing is built, thereby allowing the material of the casing to fill the gap 28 between the face and the pier to form the casing, as will be described in more details hereinafter.

In addition, the faces 24 advantageously further comprise coupling elements 30 adapted to enhance the mechanical coupling of the pier and the column. These coupling elements 30 are borne by the faces 24, and extend within the casing 26 towards the pier from the inner surface of the corresponding face 24. For instance, these elements present a general U-shape whose legs are secured to the corresponding face 24.

Advantageously, in such configurations, the pier 4 further comprise bars 32 inserted radially therein and which extend outwardly in the casing 26. The pier may comprise bars which extend towards the face 24, and/or bars which extend towards the free surfaces of the casing 26.

Figure 5:
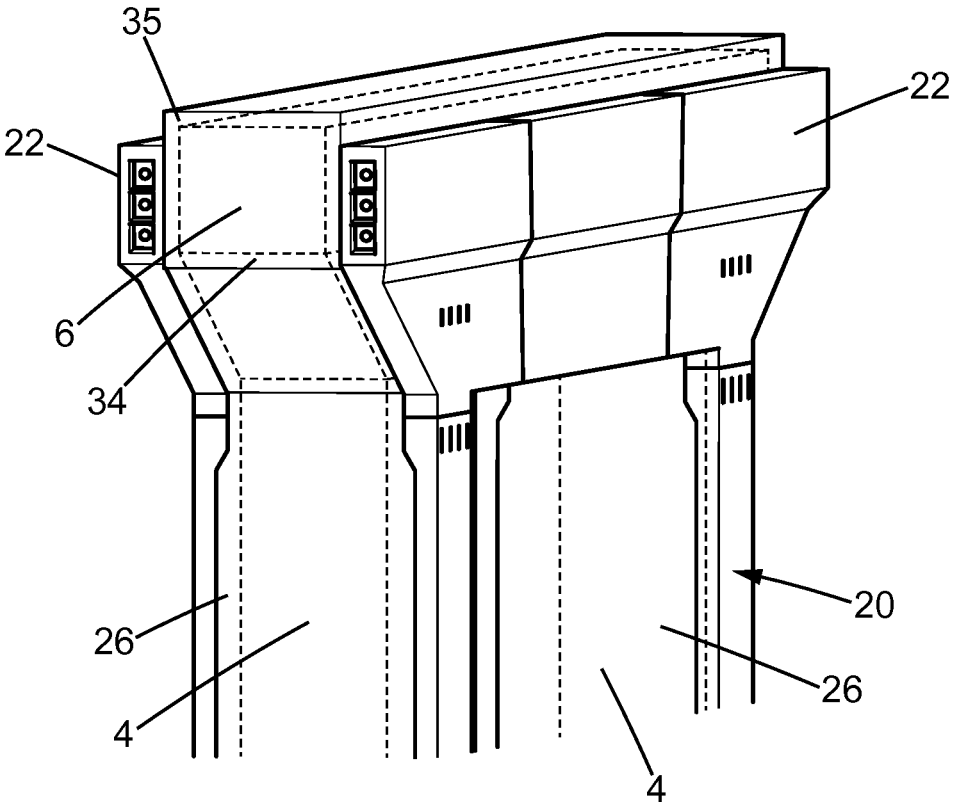
FIG. 5 illustrates a view of the assembly of FIG. 2.

In reference to FIG. 5, the transverse beam 22 is configured to reinforce the cross-beam. More precisely, it is configured to take up at least part of the loads taken up by the cross-beam.

Advantageously, the apparatus comprises two transverse beams 22. Each transverse beam is laid out transversely relative to the column(s). In other words, the columns stretch vertically, while the beams 22 stretch horizontally. Each transverse beam is associated to the column faces 24 which are located on a same side of the piers.

Advantageously, in a two-pier configuration, the transverse beams 22 stretch at least between the two piers.

Each transverse beam 22 is in a fixed position relative to the column faces. More precisely, each beam 22 comprises a lower end secured to an upper-end of at least one column. Advantageously, it is secured to both columns. Each beam and the corresponding column faces which are secured thereto preferably extend in a same plane. This plane is preferably vertical.

The securing of the transverse beams 22 is either direct or indirect. In other words, the beams 22 are attached to the upper-end of the column(s) directly, or they are secured to an intermediate component which is itself attached to the upper-end of the column(s).

Each transverse beam comprises most advantageously a plurality of prefabricated beam elements secured to each other to form at least part of the corresponding transverse beam.

For instance, these prefabricated beam elements are made of concrete, and most advantageously of UHPFRC. They are advantageously made by moulding using a mould (or "cast") and thus form precast elements.

The prefabricated elements are attached to one another using any known means.

Each beam has a thickness which is for instance comprised between 100 mm and 500 mm.

Each transverse beam has its inner face facing one of the sides of the cross-beam. In FIG. 2, the inner face of the respective beams 22 face the front side, respectively the back side of the cross-beam 6 (in the sense of the orientations of this Figure).

Preferably, the beams are laid out in parallel relative to the cross-beam.

Each beam 22 presents itself in the general shape of a panel. This panel presents the same general shape as the side of the cross-beam it is facing, and slightly greater dimensions.

In the example of FIGS. 2 and 5, each beam 22 presents a central rectangular portion which stretches between the two piers, and two end portions extending beyond the corresponding pier from the central portion and having a trapezoid shape.

Advantageously, each transverse beam 22 is located apart from the cross-beam, defining a space therebetween.

This space is advantageously at least partly filled with a reinforcement material 34, and most advantageously is entirely filled with the reinforcement material 34.

Optionally, the reinforcement material presents itself in the form of a reinforcement casing 35 which encapsulates the cross-beam 6 at least in part. Preferably, this casing entirely encapsulates the cross-beam (with the exception of the interface region between the cross-beam and the piers).

In other words, the reinforcement material then fills the space between the beams 22 and the cross-beam, but also extends vertically above and below the cross-beam and surrounds the latter, as well as longitudinally beyond the extremities of the cross-beam.

For instance, the cross-section of the casing 35 is rectangular in shape, but the dimensions of the cross-section may vary along the longitudinal direction of the cross-beam.

The lower end of the casing 35 is for instance in contact with the upper end of the casing 26 of the columns 20. For instance, the casing 35 bears on the casing 26.

The longitudinal sides of the casing each face one of the transverse beams. Advantageously, each of these sides of the casing presents the same dimensions that the transverse beam they face.

For instance, the reinforcement material is a same material as the reinforcing material of the column. For instance, it is concrete or comprises concrete.

The reinforcement material is in contact with the cross-beam and the transverse beams. Through the reinforcement material, the transverse beams 22 are mechanically coupled to the cross-beam.

Advantageously, the transverse beams are in contact with the reinforcement material over substantially the entirety of their inner face.

It should be noted that when the reinforcement material encapsulates the beam, the so-formed casing for instance comprises an upper face which is free, i.e. which is not covered by another structure, and a lower face which is also free. However, these faces may be covered by an absorptive form.

Advantageously, as for the column faces 24, the transverse beams are provided with spacer elements (not shown) which extend from the inner face of the transverse beams towards the cross-beam to maintain the transverse beams away from the cross-beam, in particular while the apparatus is being built and the reinforcement material has not yet been added.

In addition, the cross-beam optionally comprises bars which extend radially in the reinforcement material.

Optionally, the transverse beams further comprise coupling elements protruding from their inner face in the reinforcement material towards the cross-beam. For instance, these elements present themselves in the form of U-shaped elements whose ends are secured to the corresponding transverse beam.

Figure 6:
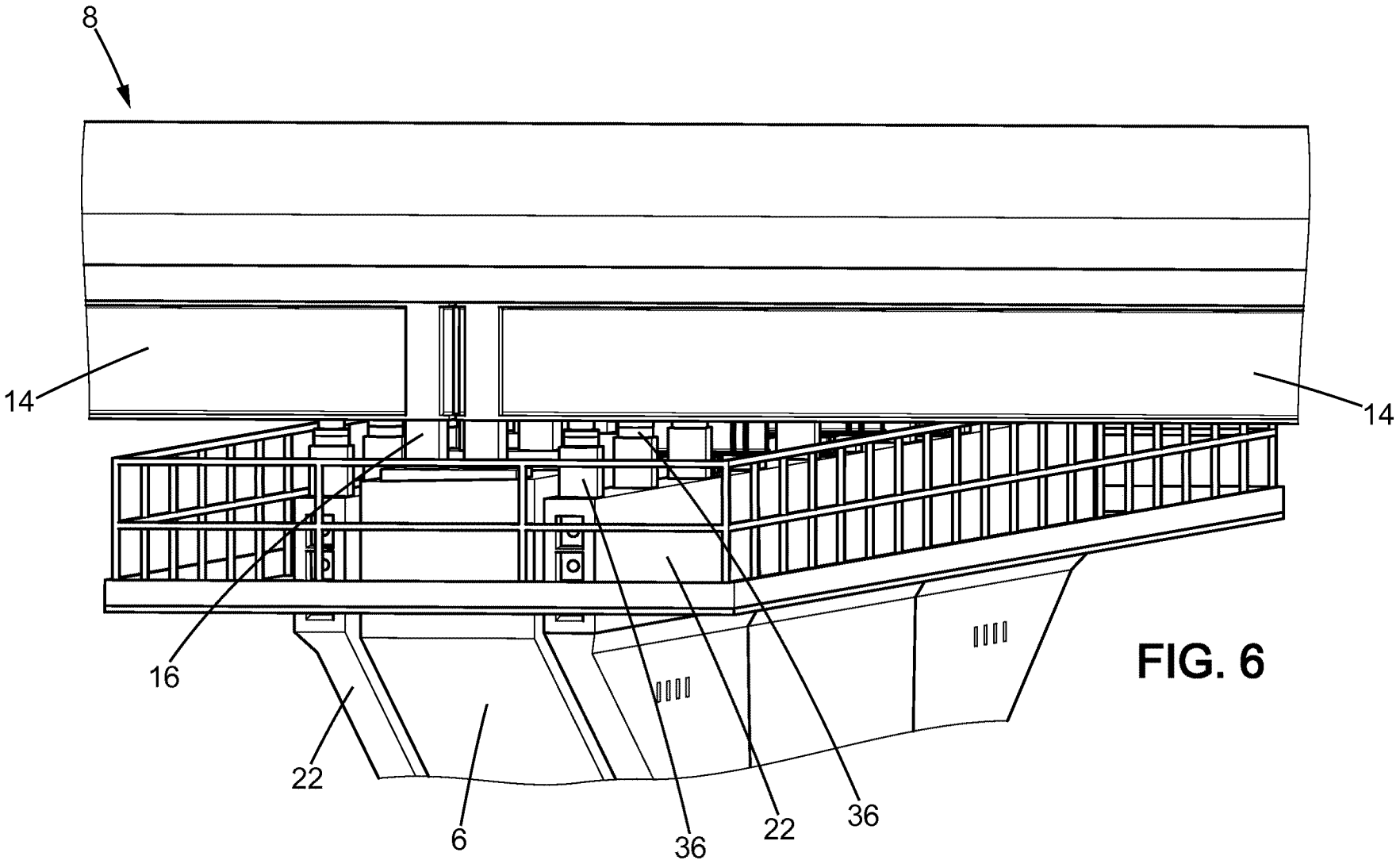
FIG. 6 illustrates an interface area between the structure and the reinforcement apparatus of FIG. 2.

In reference to FIG. 6, the apparatus further comprises load transfer elements 36 arranged to take up at least part of the load of the structure element 8.

The load transfer elements 36 are arranged on an upper-face of the transverse beams 22. Advantageously, the upper face of each transverse beam 22 comprises load transfer elements 36 distributed along the length of the corresponding transverse beams. For instance, the apparatus comprises at least two such elements 36 per transverse beams. These elements are distributed along the length of the transverse beams so as to balance the load taken up by the transverse beams between the two sides of the beam 22 (relative to a middle thereof).

For instance, these elements 36 comprise jacks, such as hydraulic jacks.

It should be noted that these elements 36 may be temporary, and are for instance used temporarily while the apparatus is being built. Alternatively, they are permanent and are thus destined to take at least part of the load of the element 8 throughout the entire lifespan of the reinforcement structure.

In addition, in certain configurations, the structure does not include bearings 16 through which the element 8 bears on the cross-beam 6. In these configurations, the elements 36 are configured to take up all the load of the element 8.

Figure 7:
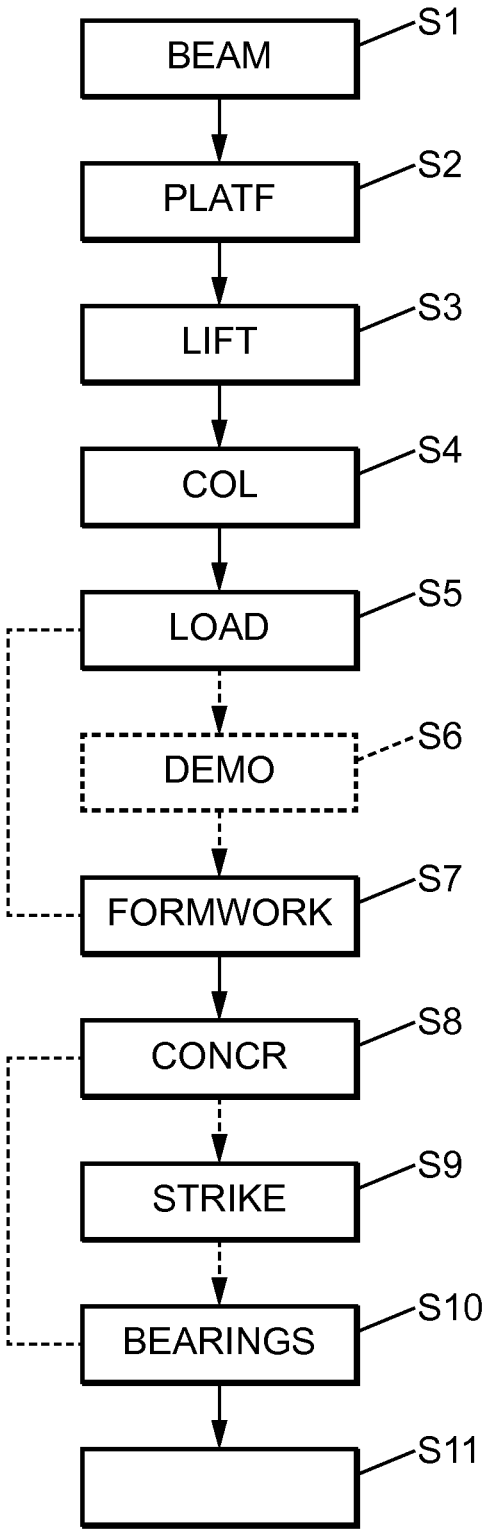
FIG. 7 illustrates the steps of a method according to the invention.

A method of building the apparatus will now be described in reference to the Figures, in particular in reference to FIG. 7 which illustrates the various steps of the method in schematic form.

The apparatus is built so as to be mechanically coupled to the structure 2 which is preexisting.

In a first step S1, the beams 22 are formed. The beams are advantageously formed directly below the element 8 near the feet of the piers. The two beams are formed in a configuration in which they are substantially parallel to the cross-beam, and are formed on different respective sides of the structure (such as the front and back sides).

To that end, the prefabricated beam elements are assembled together so as to form each of the two beams. These elements are for instance brought over to the building site using vehicles. The elements are for instance assembled over supports which are laid out on the ground or a foundation surface.

Once the two beams are formed, they are secured to each other using securing devices 38 stretching between the two beams. These devices are configured to maintain the relative spacing of the two beams and to keep them in a parallel configuration. These devices for instance include rigid frames.

Figure 8:
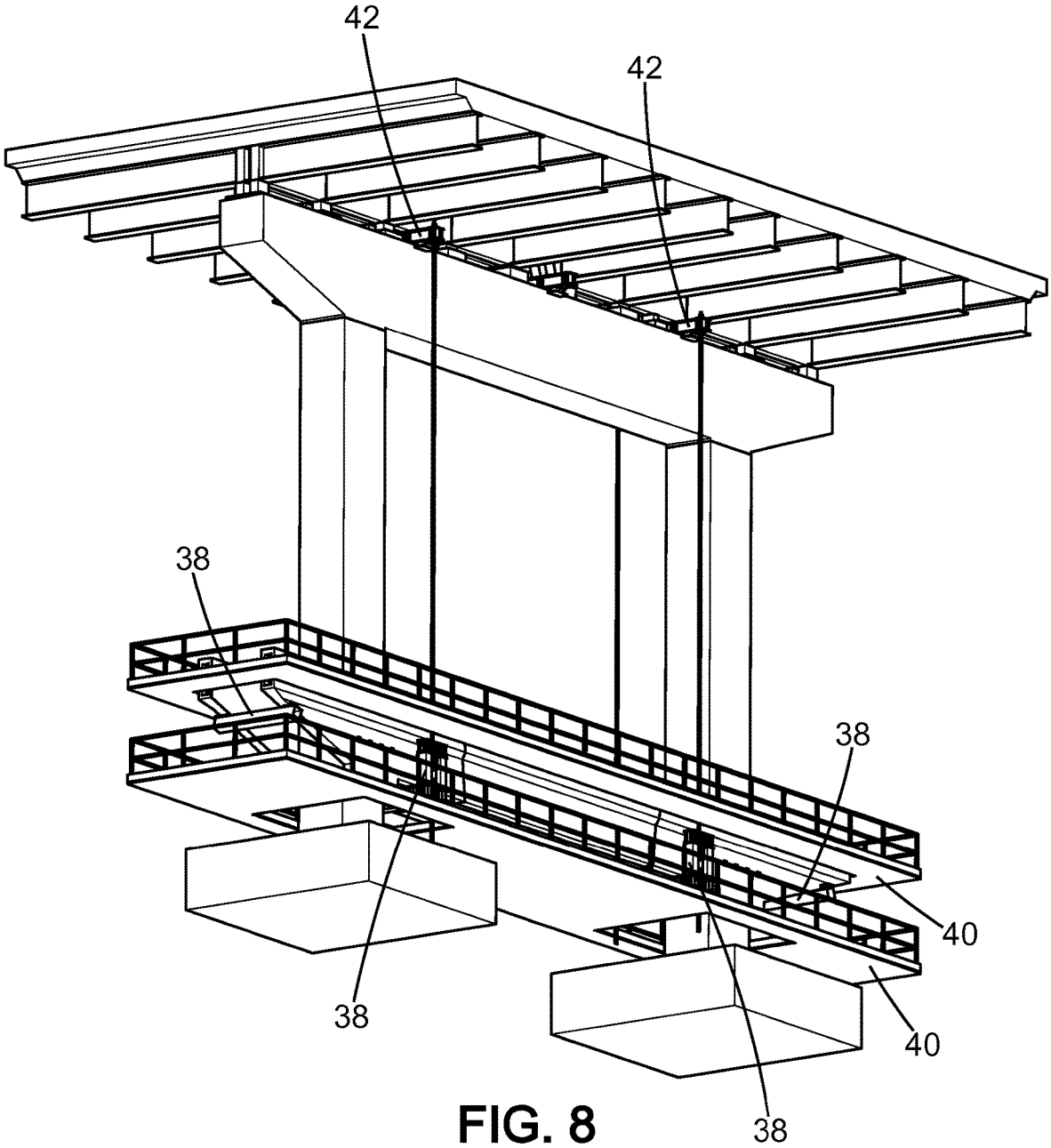
FIG. 8 illustrates a step of the method according to the invention.
Figure 9:
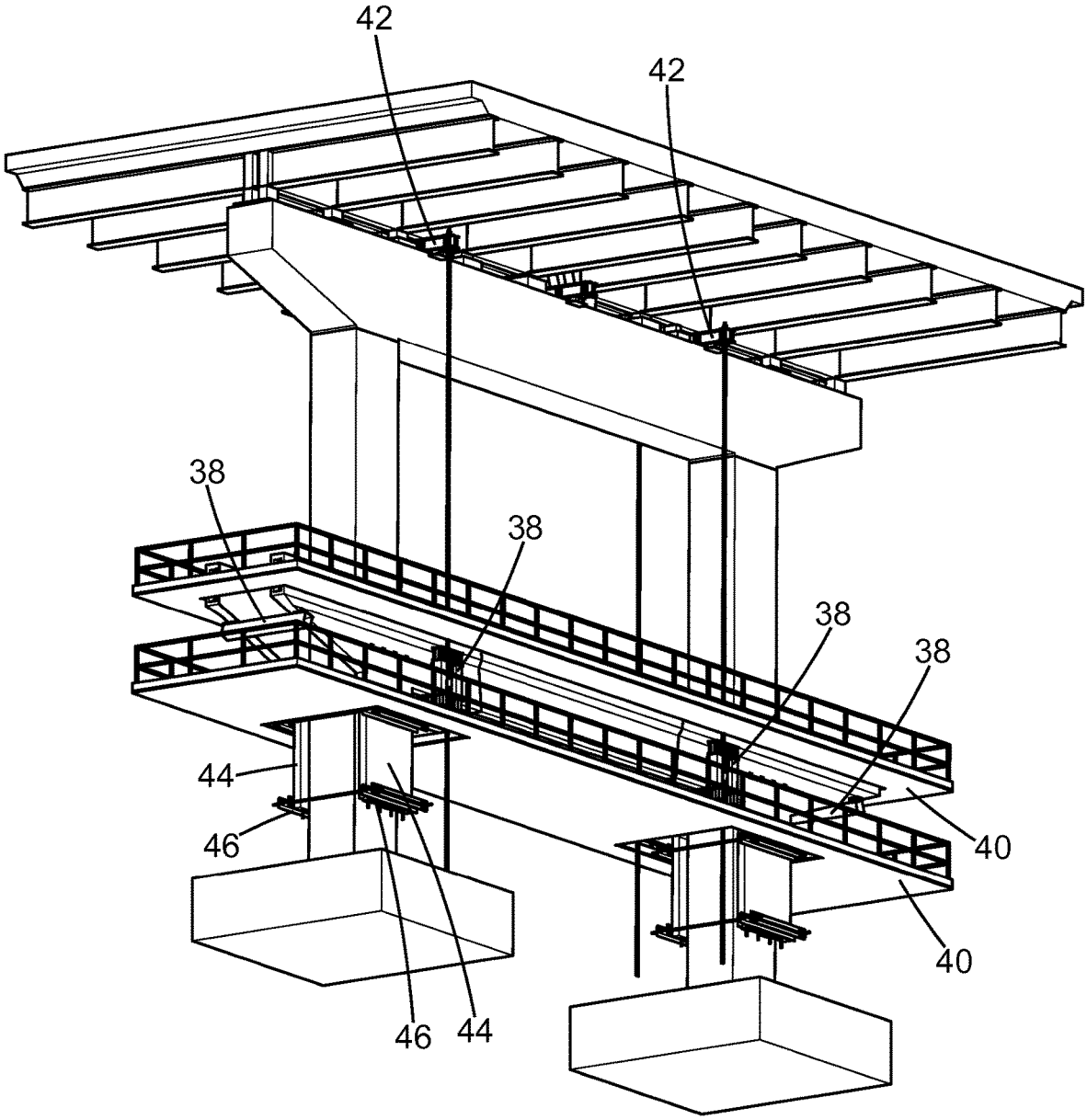
FIG. 9 illustrates another step of the method according to the invention.

In a step S2, as depicted in FIG. 8, one or more platforms 40 are secured to the transverse beams. These platforms are destined to be suspended, and are designed to grant access to operators to the interface between the beams of the element 8 and the top portion of the apparatus.

For instance, two platforms are thus installed, a top one fixedly attached to the beams 22, and a bottom one suspended to the top one.

In a step S3, the beams 22 are lifted up towards the cross-beam. To that end, lifting mechanisms 42 such as lifting cable jacks are employed. These mechanisms 42 are for instance installed on the structure 2, and preferably on the cross-beam 6.

It should be noted that these may be installed during or prior to step S2, for instance in order to slightly lift the beams for the installation of the platforms 40.

During step S3, the beams are lifted so as to free up space at the feet of the piers for the installation of the columns.

During step S4, the columns 20 are formed, at least in part.

More precisely, during the step, the faces 24 are formed.

To that end, initially, prefabricated elements of the faces 24 are assembled together to form two panels 44 which each form a stage of the corresponding column face.

Each panel 44 thus forms a vertical portion of the corresponding column face 24. The two panels are respectively arranged on two opposite sides of the pier (which match the front and back sides of the cross-beam, preferably) so as to face each other and be parallel relative to one another. In this position, they each extend in the same plane as one of the transverse beams. In addition, the optional spacing elements 29 which are on the inner surface of each panel are nearly contacting or actually contacting the pier. The panels 44 are then attached by their upper end to the lower end of the corresponding transverse beam which is located above.

Advantageously, the panels 44 are prefabricated elements, or are made of prefabricated elements.

Once set up, the two panels of a given pier are secured to each other using one or more devices 46, thereby defining a first stage of the corresponding column. These devices for instance stretch between the panels on both sides of the panels, and include rigid frames.

This first stage is built for all the column faces 24 during this step.

Thereafter, the beams and the newly attached panels are lifted so as to free up space below the first stage of the column faces to install a new stage.

The new stage comprises panels such as those previously installed, which are then arranged facing their respective side of the pier below the first stage, which are attached to the first stage above them and are secured to each other across the pier using a new device 46 (or a plurality of them) such as the one(s) used for the first stage.

This step is repeated so as to build the entire faces of each column face for each pier and to have the beams 22 at a same height as the cross-beam. The bottom stage is further laid out to bear on the foundations 10 of the structure 2.

Figure 10A:
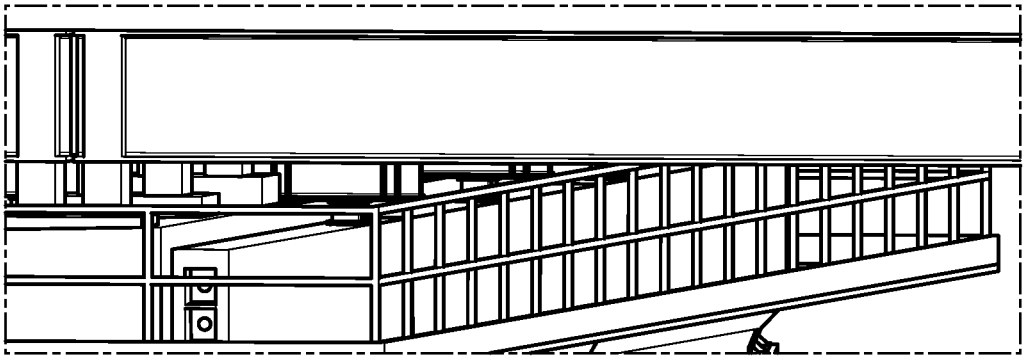
FIGS. 10*a* and 10*b* illustrate the result of an intermediate step of the method according to the invention.
Figure 10B:
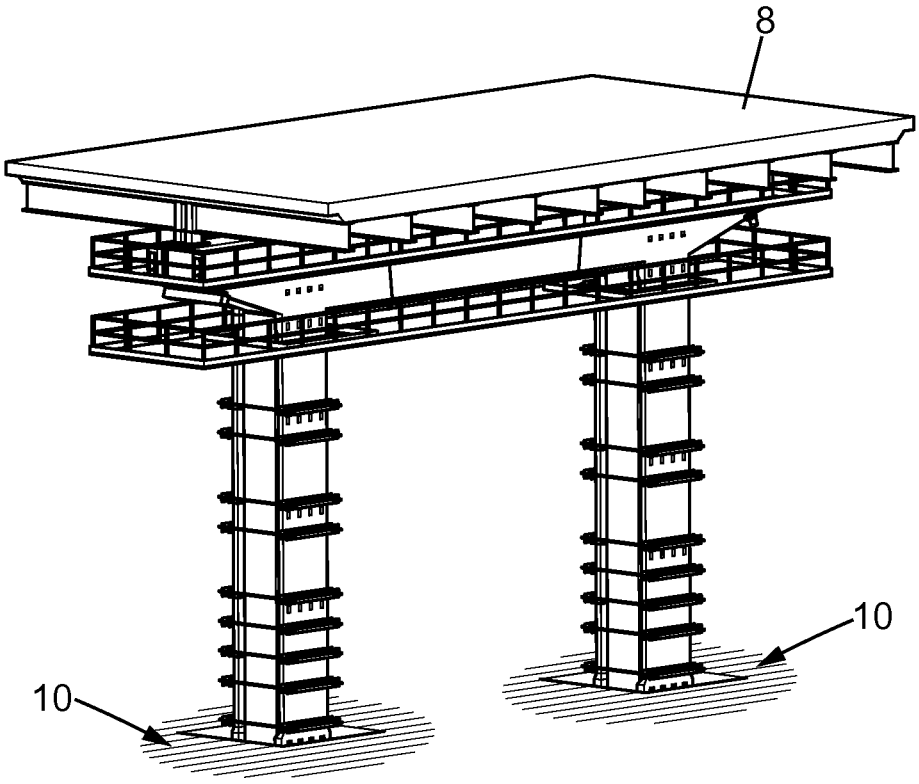

FIGS. 10*a* and 10*b* illustrate the obtained result.

It should be noted that beyond this point, the lifting mechanism may be employed to exert a stabilizing action over the beams 22 so as to stabilize the column faces 24 once they have been built, in particular to prevent their buckling. For instance, the lifting mechanism is kept in a passive configuration in which the beams are suspended thereto.

During a step S5, at least part of the load of the element 8 is transferred to the apparatus in its current form.

To that end, the elements 36 are installed on the upper faces of the beams 22 and are put in contact with the element 8.

For instance, during that step, the elements 36 are installed while the rod of the corresponding jack is fully retracted. Once installed, the rod is extended toward the element 8, its extremity thus coming in contact with the element 8. It should be noted that the extremity of the rod may have an adapted shape or may be an interface element adapted to provide desired contact properties between the elements 36 and the element 8.

Advantageously, the load transfer elements 36 then take up all the load of the element 8.

In an optional step S6, a treatment of the structure is carried out. For instance one or more of the following elements is then treated:

A portion of the pier that is not facing a column face;

A portion of the cross-beam 6 that is not facing one of the transverse beams 22;

One or more bearings 16;

One or more plinths which each serve as a support for one of the bearings 16 on the cross-beam.

For instance, this treatment comprises the removal of part of the corresponding portion, in particular regarding the pier and the cross-beam. For instance, for these two components, part of the surface thereof is removed, for instance parts that have sustained damage. This removal may be conducted by hydro-demolition.

Regarding the bearings and the plinths, the treatment for instance comprises their removal.

During a step S7, formwork elements 48 are added to the apparatus so as to define a tight formwork around the structure which defines, in cooperation with the beams 22 and the column faces 24, an inner cavity for receiving a filling material.

In effect, formwork elements are added to the sides of each of the piers between the column faces to define, conjointly with the column faces, an inner space containing the pier and the gaps between the column faces and the pier.

In addition, formwork elements which face the surfaces of the cross-beam which are facing down are added between the two transverse beams 22. Moreover, formwork elements which face the lateral extremities of the cross-beam are also added. These elements define, conjointly with the transverse beams, an internal volume comprising the spaces between the transverse beams and the cross-beam.

The inner space and the inner volume jointly form the inner cavity. This cavity stretches for instance from the foundations to the cross-beam.

Figure 11A:
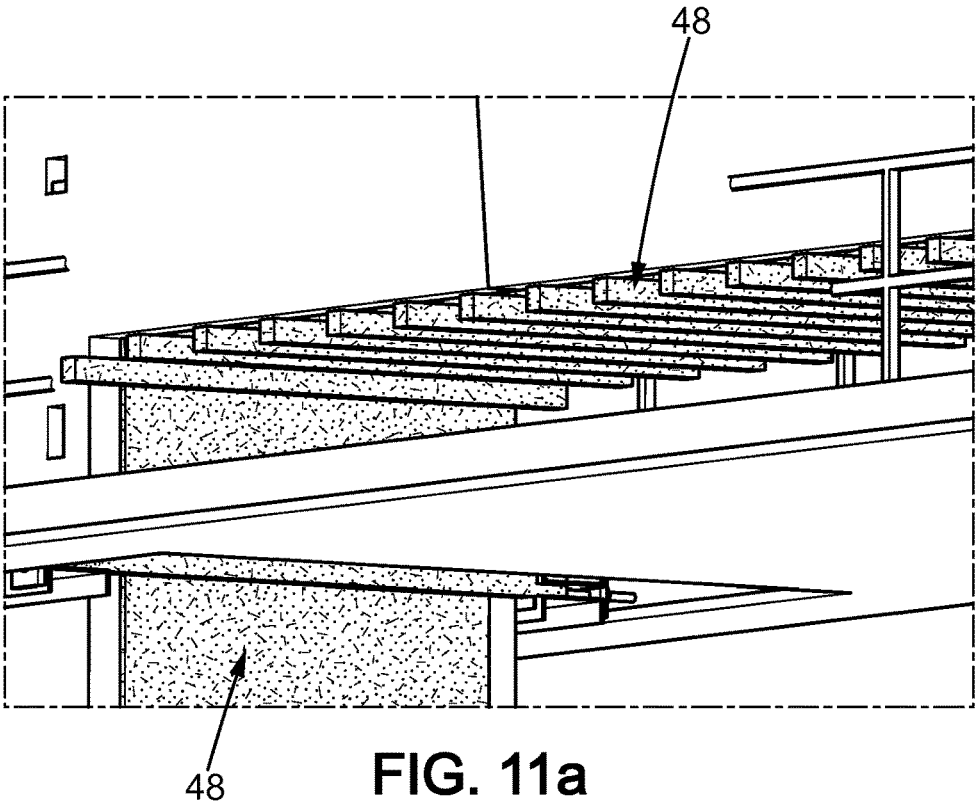
FIGS. 11*a* to 11*c* illustrate the result of another intermediate step of the method according to the invention.
Figure 11B:
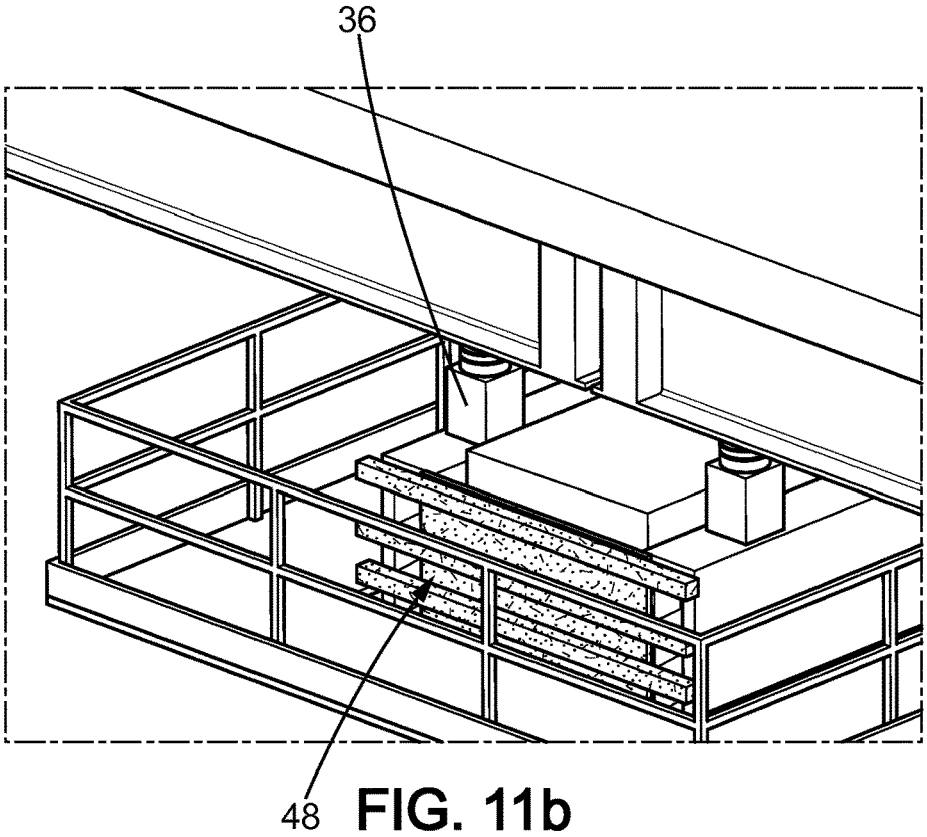
Figure 11C:
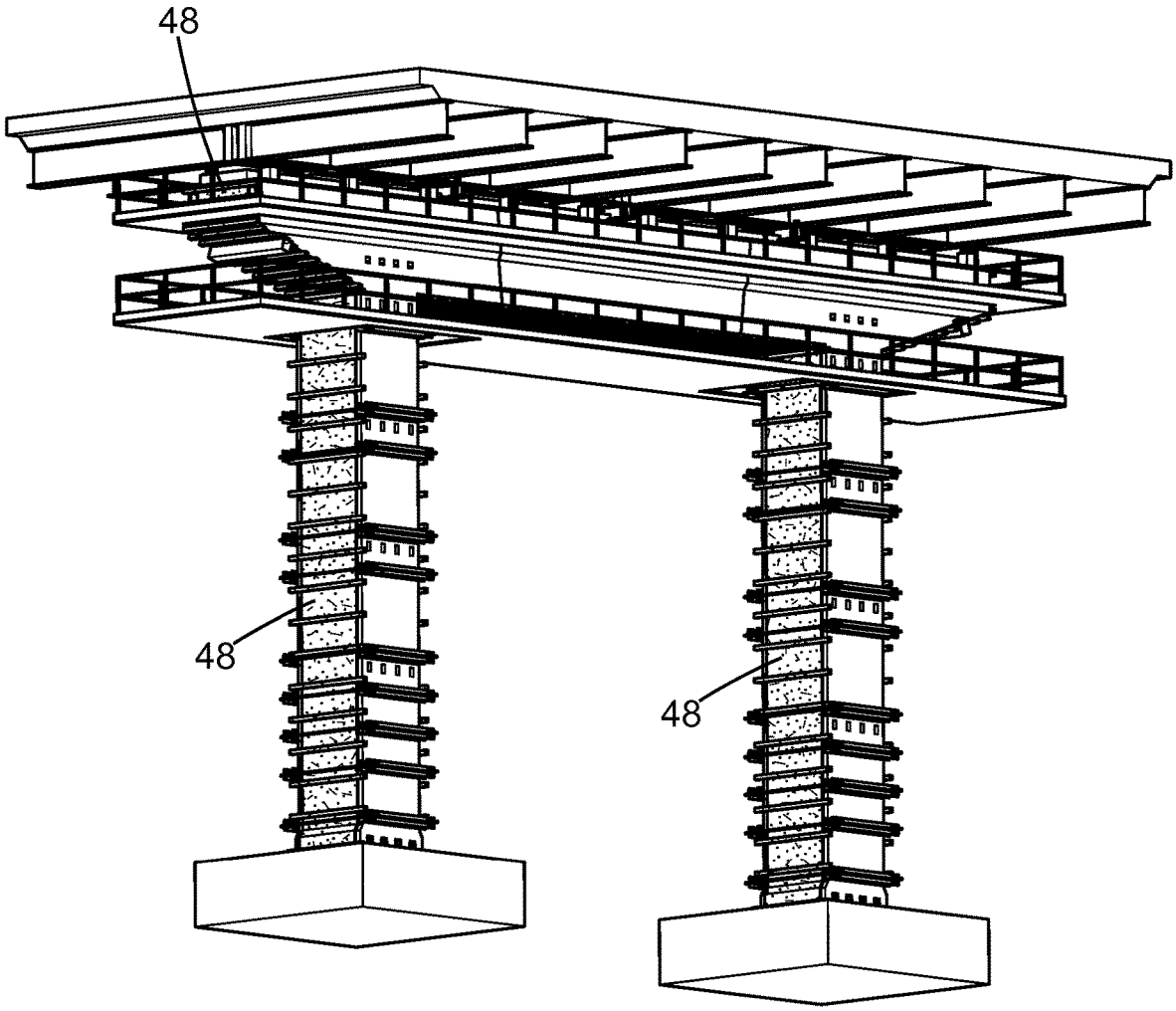

These formwork elements are illustrated in FIGS. 11*a*, 11*b* and 11*c*.

It should be noted that the formwork obtained advantageously does not include any superior cover which seals the upper part of the formwork. In other words, the formwork is open upwardly in the vicinity of the cross-beam.

In addition, it should be noted that for clarity reasons, the formwork elements in FIG. 11*b* have not all been shown. In effect, the formwork elements in this region reach higher than the cross-beam, which allows for the reinforcement casing 35 to be built through the filling of the inner cavity, as described below.

The formwork elements may be components of an absorptive form, i.e. the formwork elements are destined to stay in place after the filling material has been poured. Alternatively, they may be destined to be removed after the filling material has set.

In some configurations, part of the formwork elements are destined to stay in place while others are destined to be removed.

Elements which are to stay in place are advantageously made of concrete, and advantageously of UHPFRC.

Within the cavity, the inner space and the internal volume are in fluid communication with one another.

During a step S8, the filling material is poured in the formwork. This filling material corresponds at least to the material of the casings 26.

The filling material is advantageously concrete. The material advantageously fills the entirety of the formwork from the feet of the piers up to the cross-beam, thereby forming the casings 26 around the piers and the reinforcement casing 35 around the cross-beam.

During this step, the gaps between the column faces and the piers and the spaces between the beams 22 and the cross-beam 6 are advantageously filled in a single filling operation.

However, this step may be split in at least a first operation of filling part of the formwork after which the filling material first sets, and a posterior second operation of filling the remaining part of the formwork.

Different materials may then be used during these two steps so as to obtain casings 26 and a casing 35 which are made of different materials.

It should be noted that regardless of how this step is conducted, the reinforcement material and the reinforcing material may or may not be a same material. Advantageously, however, they are, the poured filling material having a constant composition throughout this step.

After the material has been poured in the formwork, it sets and becomes hard, thereby having the components of the apparatus adhere to the structure 2.

During an optional step S9 which is conducted once the material filling the formwork has set, the formwork elements which are to be removed are effectively removed.

During an optional step S10, replacement bearings to replace the bearings 36 are installed between the casing of the cross-beam 6 and the element 8 so as to take up at least part of the load of the element which was shifted to the apparatus.

The replacement bearings may take all the load or only part of it. In addition, as indicated, this step is optional, in that it may be chosen not to replace the bearings 36 and keep all the load on the load transfer elements 36 of the apparatus. Moreover, plinths may be arranged on the casing of the cross-beam to serve as supports for the replacement bearings.

During this step, the load transfer elements may also be removed, in particular when the replacement bearings are intended to take up all the load of the structure.

During a step S11, prestressing elements are added to the apparatus.

These prestressing elements for instance include cables, such as cables having a plurality of tendons.

Prestressing elements are for instance added to the transverse beams 22 and to the column faces. For instance, the beams 22 and the faces 24 include channels arranged within their matter, which optionally include one or more protective sheaths, and within which the prestressing elements are setup. These elements are then tensioned and anchored through any known process.

It should be noted that this step may occur entirely after the previous step, or may be split into substeps during which part of the prestressing elements are setup. For instance, a first substep is carried out for the beams 22 once they have been assembled. Another is then conducted later on, for instance after step S11. Regarding the column faces 24, all their prestressing elements are for instance setup after step S11.

Moreover, the prestressing elements may be arranged in the corresponding component at a point in time, and may be tensioned and/or anchored at a later time. For instance, the prestressing elements may all be inserted in the beams 22 right after they have been built, only one of them is tensioned and anchored, while the remaining elements are tensioned and anchored later, for instance after step S10.

During a further step, the platforms are removed, and so are the components which temporarily secured the beams together and the column faces together (if they were not removed beforehand, e.g. progressively during the step of installing the formwork).

Once finished, the presence of the apparatus which is mechanically coupled to the structure strengthens the structure. In fact, the apparatus and the structure are tightly coupled to each other through the reinforcement and reinforcing materials.

This coupling is further enhanced through the coupling elements which protrude from the beams 22 and the faces 24 into the reinforcement and reinforcing materials, all the more so when the piers and the cross-beam also exhibit bars protruding in the latter.

Through this coupling, at least part of the load of the element bearing on the structure is taken up by the apparatus, regardless of whether the apparatus presents load transfer elements.

The invention thereby serves to greatly increase the structural properties and durability of the structure-apparatus assembly compared to the structure alone.

In addition, it is of simple conception, and prevents the occurrence of temporary situations in which the structure sees its structural properties weakened without this phenomenon being thoroughly accounted for.

Moreover, the apparatus is adapted for taking up all the load of the element 8 should it be needed, the structure then providing the apparatus with the required stability, in particular in terms of buckling.

The above description has been given in reference to a configuration in which the structure 2 forms part of a bridge. However, the apparatus is adapted for any kind of structure comprising a pier, a cross-beam and a structure element bearing on the cross-beam.

Moreover, the structure has been depicted as including two piers. Yet, the transposition to other configurations, in particular to structures comprising one or three or more consecutive piers, is immediate.

In fact, the number of columns the apparatus comprises depends on the number of piers over which the cross-beam stretches. In typical configurations, the cross-beam may bear on two, three or more piers. The apparatus then comprises a same number of columns, and two transverse beams which have the configuration described above relative to the cross-beam and each of the corresponding columns.

However, as indicated above, the structure 2 may comprise a single pier. In such a configuration, the cross-beam and the pier are for instance in a T-shape configuration, the cross-beam bearing on the pier in its central region and extending sideways from the upper end of the pier.

The invention claimed is:

1. A reinforcement apparatus for reinforcing a structure, the structure comprising at least one pier bearing on foundations, a cross-beam bearing on the pier and at least one structure element located above the cross-beam, the reinforcement apparatus comprising:

at least one column to surround the pier at least partly, to be mechanically coupled to the pier and to bear on the foundations; and at least one transverse beam fixed relative to the column and to be mechanically coupled to the cross-beam, wherein the at least one column comprises two column faces facing the pier and respectively located on opposite sides of the pier, each column face and the pier defining a gap therebetween, each gap being at least partly filled with a reinforcing material, and wherein the at least one column further comprises a casing surrounding the pier at least partly, the casing being made of the reinforcing material at least in part.

2. The reinforcement apparatus according to claim 1, wherein the column comprises a plurality of prefabricated column elements assembled together.

3. The reinforcement apparatus according to claim 1, wherein the transverse beam comprises a plurality of prefabricated beam elements assembled together.

4. The reinforcement apparatus according to claim 1, comprising at least one load transfer element arranged on an upper face of the at least one transverse beam to take up at least part of the load of the structure element.

5. The reinforcement apparatus according to claim 1, wherein the structure comprises a plurality of piers bearing on the foundations, wherein the cross-beam bears on the plurality of piers, the reinforcement apparatus comprising, for each pier the cross-beam is bearing on, a column destined to surround said pier at least partly, to be mechanically coupled to the pier and to bear on the foundations.

6. The reinforcement apparatus according to claim 1, wherein the reinforcing material mechanically couples each column face to the pier.

7. The reinforcement apparatus according to claim 1, wherein the reinforcement apparatus comprises two transverse beams respectively arranged on two opposite sides of the cross-beam.

8. The reinforcement apparatus according to claim 7, wherein each transverse beam and the cross-beam define a space therebetween, each space being at least partly filled with a reinforcement material which mechanically couples the transverse beams to the cross-beam.

9. The reinforcement apparatus according to claim 8, wherein the reinforcement material is in the form of a reinforcement casing encapsulating at least part of the cross-beam.

10. An assembly comprising:

a structure comprising at least one pier bearing on foundations, a cross-beam bearing on the pier and at least one structure element located above the cross-beam; and a reinforcement apparatus having at least one column surrounding the pier at least partly, wherein the at least one column is mechanically coupled to the pier and bears on the foundations, wherein the at least one column comprises two column faces facing the pier and respectively located on opposite sides of the pier, wherein each column face and the pier defining a gap therebetween, each gap being at least partly filled with a reinforcing material, wherein the at least one column further comprises a casing surrounding the pier at least partly, the casing being made of the reinforcing material at least in part, and wherein the reinforcement apparatus further comprises at least one transverse beam fixed relative to the column and mechanically coupled to the cross-beam.

11. A method of building a reinforcement apparatus for reinforcing a structure, the structure comprising at least one pier bearing on foundations, a cross-beam bearing on the pier and at least one structure element located above the cross-beam, the reinforcement apparatus comprising at least one column to surround the pier at least partly, to be mechanically coupled to the pier and to bear on the foundations, and at least one transverse beam fixed relative to the column and to be mechanically coupled to the cross-beam, the method comprising:

forming the transverse beam, lifting the transverse beam towards the cross-beam, forming at least part of the column such that at least part of the column bears on the foundations, including arranging the at least part of the column and the transverse beam in a fixed relative position, mechanically coupling the at least part of the column to the pier to form the column and mechanically coupling the transverse beam to the cross-beam, wherein forming at least part of the column comprises:

arranging column elements around the pier and securing the columns elements together so as to define a stage of the column, attaching the stage to the transverse beam, lifting the transverse beam and the stage to free up space below the stage, arranging new column elements around the pier in the freed-up space and securing the new columns elements together so as to define a new stage of the column, and securing the new stage to the stage of the column previously formed.

12. The method according to claim 11, wherein forming the transverse beam comprises assembling together a plurality of prefabricated beam elements.

13. The method according to claim 11, wherein the column comprises two column faces facing the pier and respectively located on opposite sides of the pier, wherein mechanically coupling the at least part of the column to the pier comprising filling at least part of each gap defined between a column face and the pier with a reinforcing material.

14. The method according to claim 13, further comprising:

coupling formwork elements to the two column faces to define, with the two column faces, an inner space comprising the gaps between the column faces and the pier; and filling the inner space at least in part with the reinforcing material to form a casing with encapsulates at least part of the pier.

15. The method according to claim 11, wherein the reinforcement apparatus comprises two transverse beams respectively arranged on two opposite sides of the cross-beam, the method further comprising:

coupling formwork elements to the two transverse beams to define an inner volume which comprises spaces defined between the transverse beams and the cross-beam, and filling the inner volume at least in part with a reinforcement material to define a reinforcement casing which encapsulates at least part of the cross-beam.

16. The method according to claim 15, wherein the column comprises two column faces facing the pier and respectively located on opposite sides of the pier, wherein mechanically coupling the at least part of the column to the pier comprising filling at least part of each gap defined between a column face and the pier with the reinforcing material, wherein the inner space and the inner volume are in fluid communication, and wherein the operations of filling the inner space and the inner volume are carried out in a single filling step.

17. The method according to claim 11, further comprising:

arranging at least one load transfer element on an upper face of the transverse beam; and bringing the load transfer element in contact with the structure element so as to take up at least part of a load previously applied by the structure element to the cross-beam.

18. The method according to claim 11, further comprising securing a platform to be suspended to the transverse beam while the transverse beam is being formed or after the transverse beam has been formed.

* * * * *